US007588149B2

(12) United States Patent
Gelardi

(10) Patent No.: US 7,588,149 B2
(45) Date of Patent: Sep. 15, 2009

(54) UNIT DOSE CONTAINER WITH LOCKING SLEEVE

(75) Inventor: John A. Gelardi, Kennebunkport, ME (US)

(73) Assignee: MeadWestvaco Corporation, Glen Allen, VA (US)

( * ) Notice: Subject to any disclaimer, the term of this patent is extended or adjusted under 35 U.S.C. 154(b) by 325 days.

(21) Appl. No.: 11/111,223

(22) Filed: Apr. 21, 2005

(65) Prior Publication Data

US 2005/0183981 A1 Aug. 25, 2005

Related U.S. Application Data

(63) Continuation of application No. PCT/US03/33667, filed on Oct. 22, 2003.

(60) Provisional application No. 60/419,975, filed on Oct. 22, 2002.

(51) Int. Cl.
*B65D 83/04* (2006.01)

(52) U.S. Cl. ..... 206/531; 206/538; 206/1.5; 206/528

(58) Field of Classification Search ..... 206/531, 206/539, 1.5, 807, 538, 828, 467–468, 532, 206/528; 220/345.1–345.3
See application file for complete search history.

(56) References Cited

U.S. PATENT DOCUMENTS 3,199,489 A * 8/1965 Ruoss et al. ..... 116/308
3,387,699 A 6/1968 Heller
4,120,400 A * 10/1978 Kotyuk ..... 206/528
4,192,422 A * 3/1980 Kotyuk ..... 206/528
5,019,125 A 5/1991 Rebne et al.
5,080,222 A * 1/1992 McNary ..... 206/1.5
5,082,137 A * 1/1992 Weinstein ..... 220/345.3
5,275,291 A 1/1994 Sledge
5,368,187 A * 11/1994 Poncetta et al. ..... 221/30
5,788,079 A * 8/1998 Bouthiette ..... 206/534
5,878,887 A * 3/1999 Parker et al. ..... 206/528
6,036,018 A * 3/2000 Harrold ..... 206/536
6,155,423 A * 12/2000 Katzner et al. ..... 206/531

(Continued)

FOREIGN PATENT DOCUMENTS

DE 40 01 645 A1 8/1991

(Continued)

OTHER PUBLICATIONS

U.S. Appl. No. 11/969,146, filed Oct. 23, 2008, Gelardi, John A.

(Continued)

*Primary Examiner*—Mickey Yu
*Assistant Examiner*—Steven A. Reynolds
(74) *Attorney, Agent, or Firm*—Alison R. Scheidler; Tsugihiko Suzuki

(57) ABSTRACT

A container includes a slidable tray and a locking sleeve. The tray is a conventional blister package, with blisters formed therein. The tray includes a slot and the sleeve includes a stop that extends through the slot to prevent the tray from sliding out of the sleeve. The sleeve includes detents that engage with holes in the tray to lock the tray in multiple positions. Manipulating a biaser releases the detents from the holes, thereby allowing the tray to slide within the sleeve.

53 Claims, 7 Drawing Sheets

U.S. PATENT DOCUMENTS

| | | | | |
|---|---|---|---|---|
| 6,338,408 | B1 | 1/2002 | Anderson | |
| 6,349,831 | B1 * | 2/2002 | Buss | 206/531 |
| 6,460,693 | B1 | 10/2002 | Harrold | |
| 6,789,677 | B2 * | 9/2004 | Maietta | 206/536 |
| 6,863,175 | B2 * | 3/2005 | Gelardi | 206/1.5 |
| 6,896,138 | B2 * | 5/2005 | Rock et al. | 206/531 |
| 2003/0062287 | A1 | 4/2003 | Gelardi | |
| 2003/0102321 | A1 | 6/2003 | Maietta | |
| 2003/0209460 | A1 | 11/2003 | Bolnick et al. | |
| 2005/0183981 | A1 | 8/2005 | Gelardi | |

FOREIGN PATENT DOCUMENTS

| | | | |
|---|---|---|---|
| EP | 0547730 | A2 | 6/1993 |
| EP | 1 002 744 | A1 | 5/2000 |
| EP | 1277670 | B1 | 5/2005 |
| GB | 1279941 | | 6/1972 |
| JP | 2000 062843 | | 2/2000 |
| WO | WO 2004/037657 | A2 | 5/2004 |
| WO | WO 2005/030606 | A1 | 4/2005 |
| WO | WO 2005/068304 | A2 | 7/2005 |
| WO | WO 2007/101098 | A1 | 9/2007 |

OTHER PUBLICATIONS

U.S. Appl. No. 11/969,616, filed Jan. 4, 2008, Williams, Ricky.
U.S. Appl. No. 11/969,100, filed Oct. 16, 2008, Gelardi, John A.
U.S. Appl. No. 11/994,811, filed Jan. 4, 2008, Le, Thanhhung.

* cited by examiner

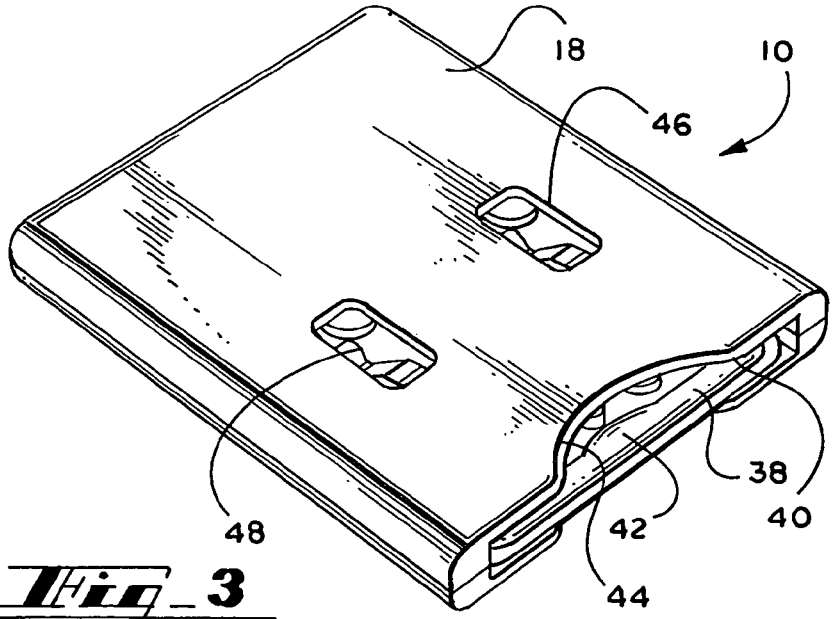
Fig_3
Fig_4
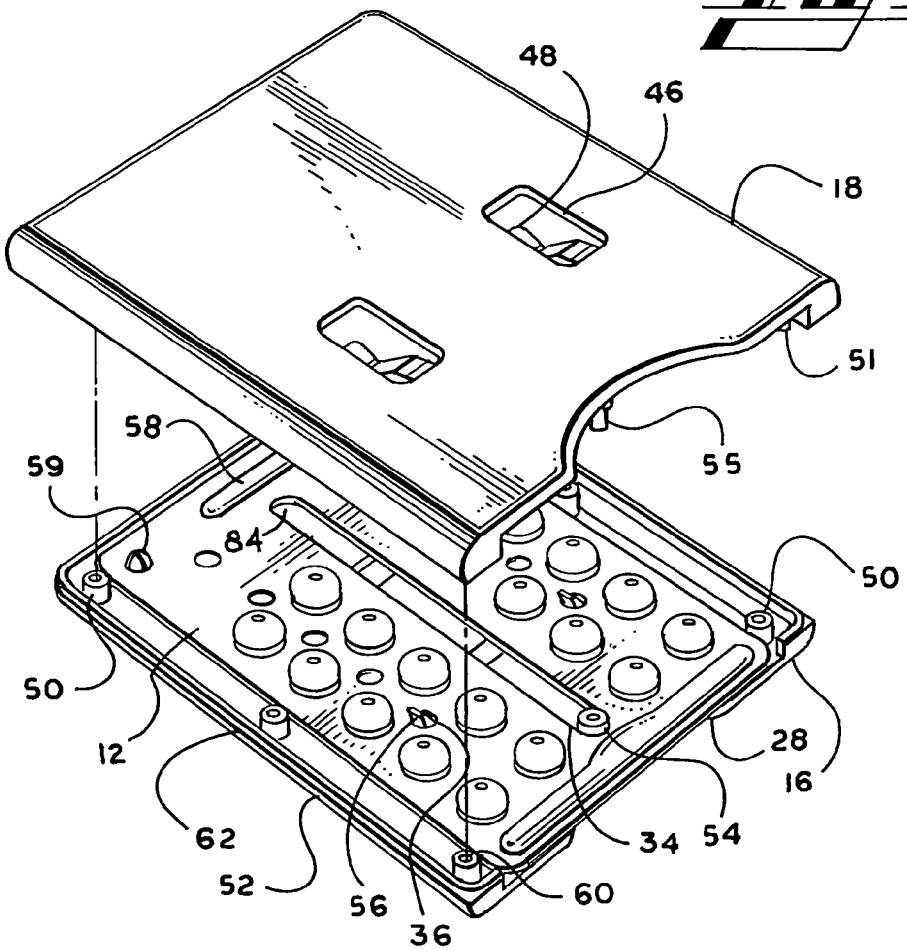

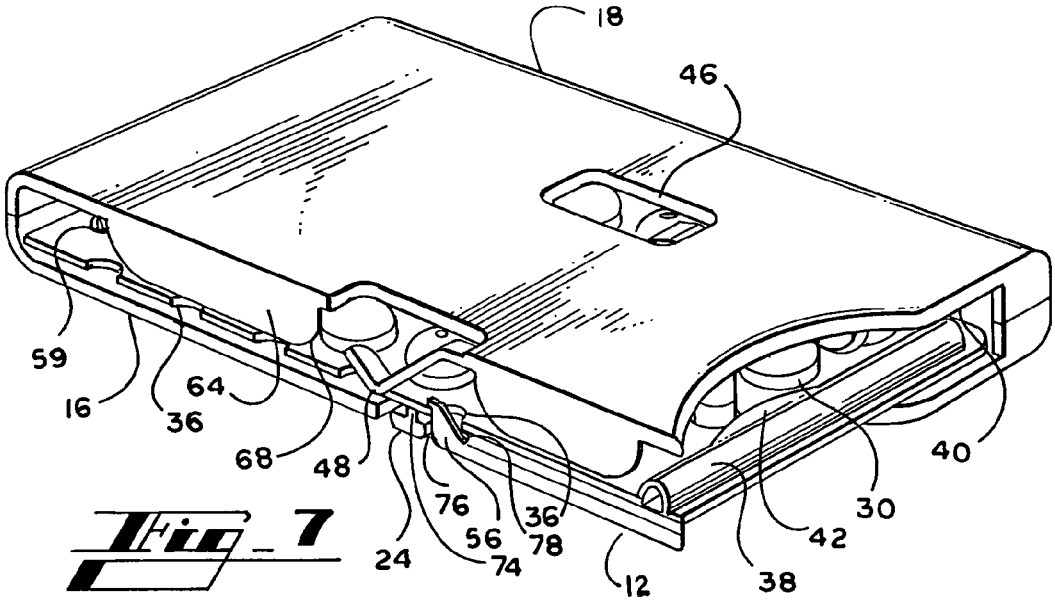
Fig_7
Fig_8
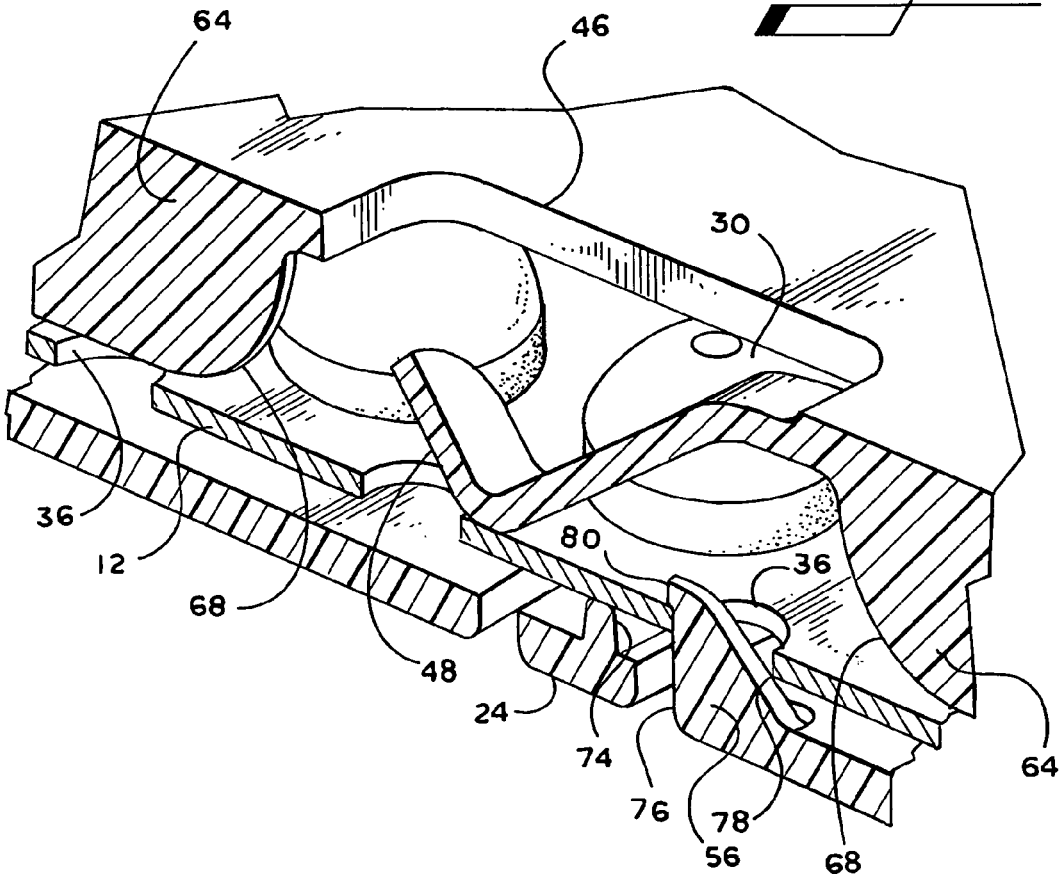

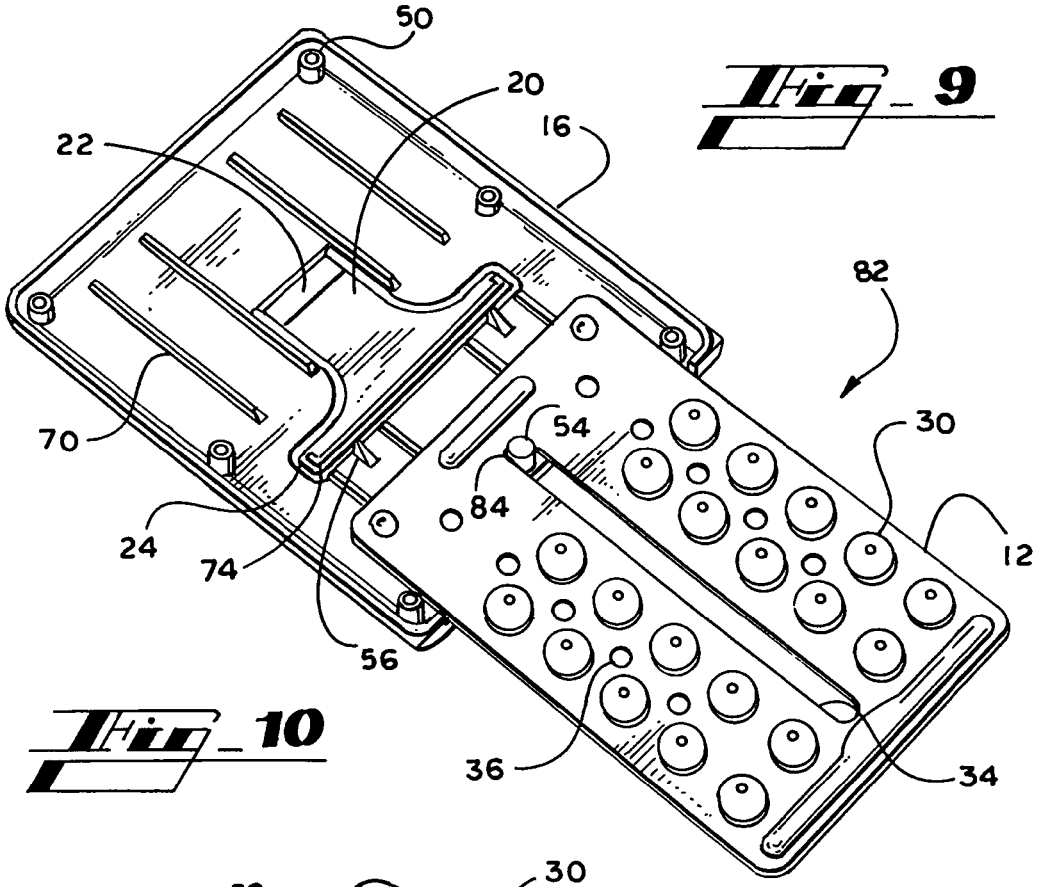
Fig_9
Fig_10
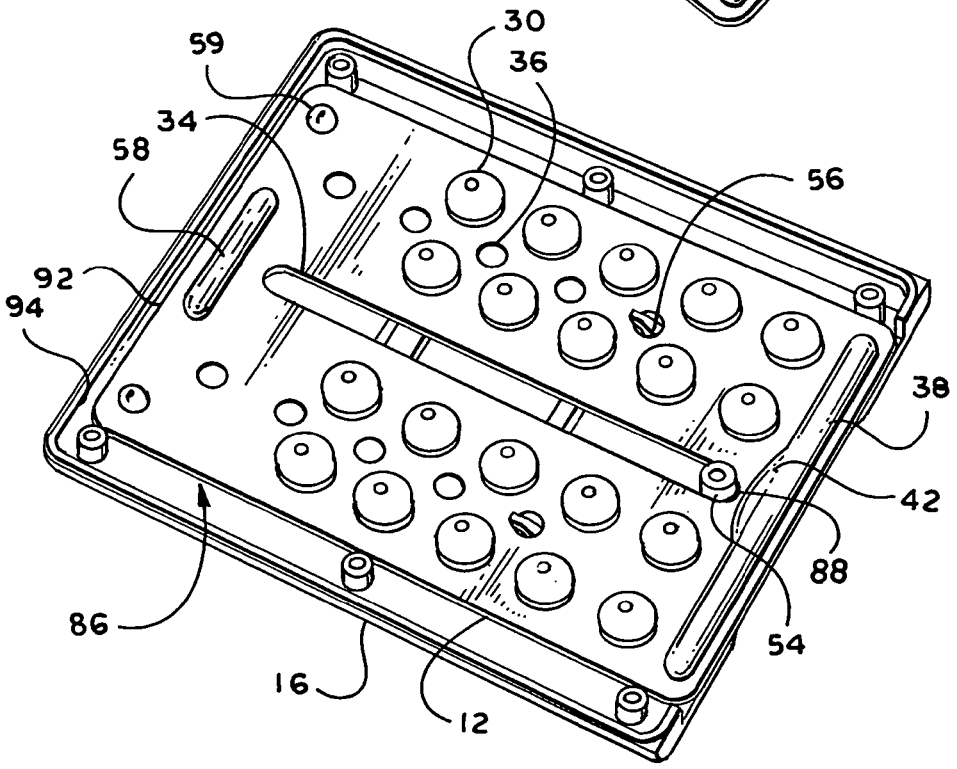

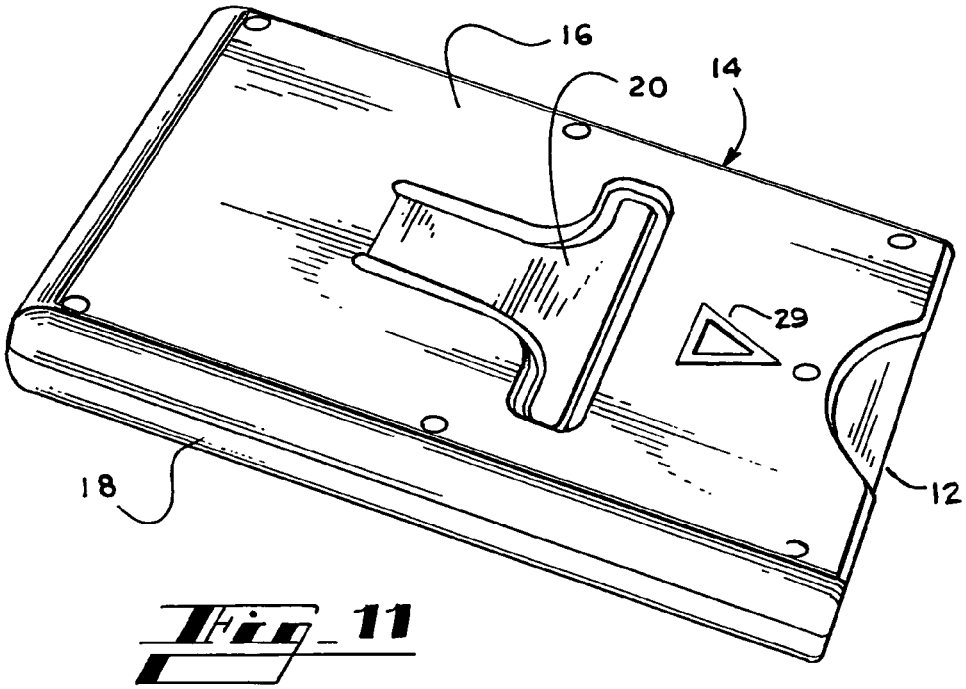
Fig_11
Fig_12
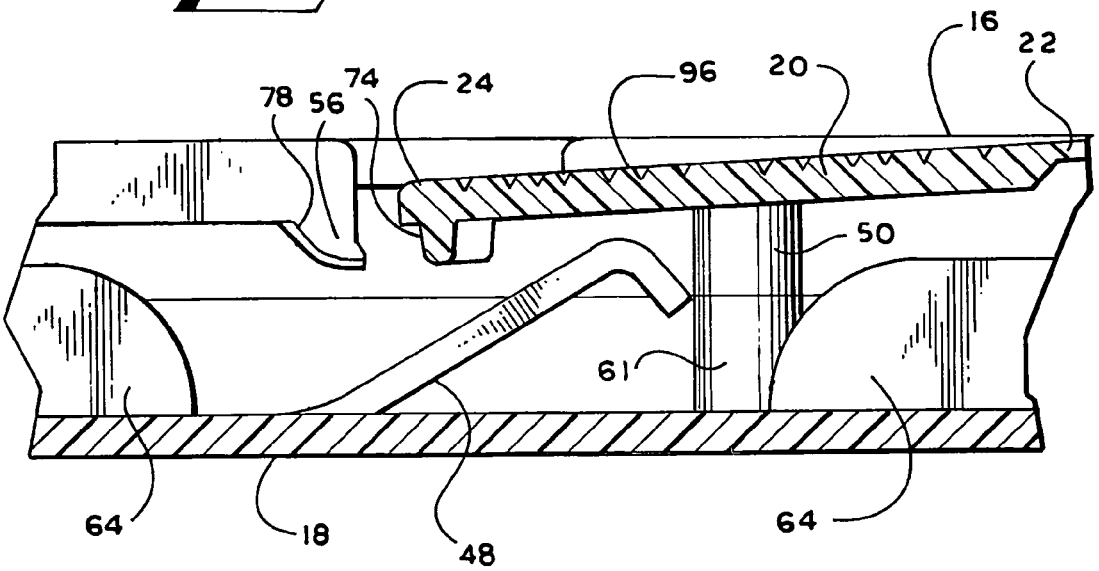

UNIT DOSE CONTAINER WITH LOCKING SLEEVE

CROSS-REFERENCE TO RELATED APPLICATION

This application is a continuation of International Application No. PCT/US03/033667, filed Oct. 22, 2003, which claims priority to U.S. Provisional Application No. 60/419,975 filed Oct. 22, 2002. The aforementioned applications are herein incorporated by reference.

FIELD OF THE INVENTION

The present invention relates generally to apparatus and methods of packaging and dispensing items or products, and more specifically, the present invention is directed to a locking container including a tray for dispensing items.

BACKGROUND OF THE INVENTION

Locking containers, especially childproof locking containers in which multiple movements must be applied to open the container, have many uses. One use for locking containers includes medicine containers. Locking caps on medicine bottles are well known. The locking caps usually require alignment and tipping, axial pressure, or inward radial squeezing while turning the locking caps to remove the locking caps from the containers and provide access to the medicine therein.

Many medicines are packaged in flat boxes formed from paperboard sleeves, which are difficult to secure with childproof locks. Such medicines are also generally packaged in blister packs having blisters or compartments formed from a plastic sheet and sealed by a paper layer or foil, which is punctured or ruptured to release a dose from a corresponding blister. Generally, when a paperboard sleeve containing blister packs are opened the entire contents of the package are exposed, making all of the doses immediately available. This easy access poses a danger to an unintended user, such as a child.

Accordingly, there remains in the art a need for inexpensive flat boxes that include locks which require multiple coordinated motions for opening the boxes and gaining access to a limited number of doses at one time. There is also a need for apparatus and methods for packaging and dispensing items that provide easy limited access for an adult while providing a high degree of security against an unintended user, such as a child.

SUMMARY OF THE INVENTION

The present invention overcomes the deficiencies of the known art and the problems that remain unsolved by providing a child-resistant locking container that is inexpensive and easy to assemble. The child-resistant locking container includes a sleeve having a locking mechanism that prevents or at least frustrates the unintentional withdraw of a tray holding medicine. The sleeve includes an unlocking member wherein pressure may be exerted on the unlocking member to bias the member inward to release the locking mechanism, thereby allowing a user to pull the tray from the sleeve. The child-resistant locking container includes security features which mandate a combination of coordinated, sequential motions, including pressing and holding the unlocking member while pulling the tray outward and then releasing the unlocking member to gain access to a limited number of items at one time.

In accordance with one embodiment of the present invention, there is provided a system for dispensing items comprising a tray, including a control slot extending through the tray and a plurality of compartments where each compartment may or may not hold at least one item, a sleeve including a lug, the lug extending through the control slot of the tray for guiding the tray within the sleeve, detents positioned within the sleeve and cooperating with the tray for preventing sliding of the tray, and a biaser connected to the sleeve for biasing the detents out of engagement with the tray for sequentially limiting the sliding of the tray through the sleeve.

Advantageously, the tray includes detent holes arranged on the tray for cooperatively engaging with the detents to prevent the tray from sliding. The tray further includes a stopping end for engaging with the lug and preventing the unintentional removal of the tray from the sleeve. Preferably the sleeve includes a base and top where the base and the top include inward facing interlocking pins and receivers for connecting the base and top together, to form a closed end and an open end opposite the closed end. The tray is configured to slide through the open end. The top includes resilient springs extending inward into the sleeve through gaps which are opposite from the biaser; the springs urging against the tray to engage the detents within the detent holes.

In alternative embodiments of the present invention, there are provided methods of packaging items within a container. One method comprises the steps of: constructing a tray to include a slot extending through the tray and a plurality of compartments for holding items, loading and sealing at least one item into a compartment of the tray, placing the tray onto a base where the base includes a lug extending through the slot for guiding the tray, attaching a top to the base to form a sleeve including a void and an open end configured to receive the tray, positioning detents within the sleeve where the detents cooperate with the tray for preventing sliding of the tray, and connecting a biaser to the sleeve for biasing the detents out of engagement with the tray for sequentially limiting the sliding of the tray through the open end of the sleeve.

Regarding the embodiments described herein, as well as those covered by the claims, the locking container may be loaded or reloaded with a new tray at the manufacturer, by the user at home, or at any location by a health care provider. The locking container may be disposable or reusable and may or may not be transparent, to allow a user to view the contents of the container. In addition, the locking container may or may not include patent information indicia, or indicators such as an arrow or directives for indicating to a user which direction to slide the tray.

In another embodiment of the present invention, there is provided a device for dispensing items, comprising: a tray including a slot extending through the tray and a plurality of compartments; a sleeve including means for stopping, means for stopping extending through the slot of the tray; means for locking configured within the sleeve, means for locking cooperating with the tray for preventing sliding of the tray; and means for unlocking connected to the sleeve, means for unlocking configured to manipulatively bias means for locking out of engagement with the tray for sequentially limiting the sliding of the tray.

Embodiments of the present invention provide a tray for holding items, comprising: a card including a slot protruding through the card, a plurality of compartments where at least one compartment holds at least one item, a plurality of holes arranged on the card, and a tab formed at one end of the card for aiding in grasping the card. Preferably, but not necessarily the slot extends centrally on the card and forms a stopping end and a closing end. In one design the plurality of compartments are configured into a plurality of rows where at least a first row is disposed on a first side of the slot and at least a second row is disposed on an opposite second side of the slot. In another design the tray includes a plurality of holes that are serially disposed in rows, where a first row of holes is disposed on a first side of the slot and a second row is disposed on an opposite second side of the slot.

Regarding the embodiments described herein, as well as those covered by the claims, the card may or may not be disposable and may comprise a conventional blister package or tray having compartments formed of a single layer plastic top material and dimensioned to fit within a locking sleeve. Further, the terms "top" and "base" and "bottom" are merely directional in order to distinguish one section from another. Accordingly the terms are not limitations but may be used interchangeably.

BRIEF DESCRIPTION OF THE DRAWINGS

FIGS. 2 and 3 are top perspective views of locking containers, according to the present invention.

FIG. 4 is an exploded view of the locking container of FIG. 3.

FIGS. 7 and 8 are cross-sectional views of locking containers, according to the present invention.

FIGS. 9 and 10 are perspective views of a base engaging with a tray, according to the present invention.

FIG. 11 is a perspective view of the locking container, according to the present invention.

FIG. 12 is a cross-sectional view of the locking container showing the attachment of a base and a top, according to the present invention.

DETAILED DESCRIPTION

As required, detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not limiting but serve as a basis for the claims and for teaching one skilled in the art to variously employ the present invention.

Further, it will be understood that the present invention is applicable to the packaging, storing, and dispensing of various items or products including but not limited to pills, tablets, capsules, lozenges, drug delivery devices, medications, non-medications, and all manner of small and portable items or products that a user may wish to keep secure and dispense in a regulated manner.

Figure 1:
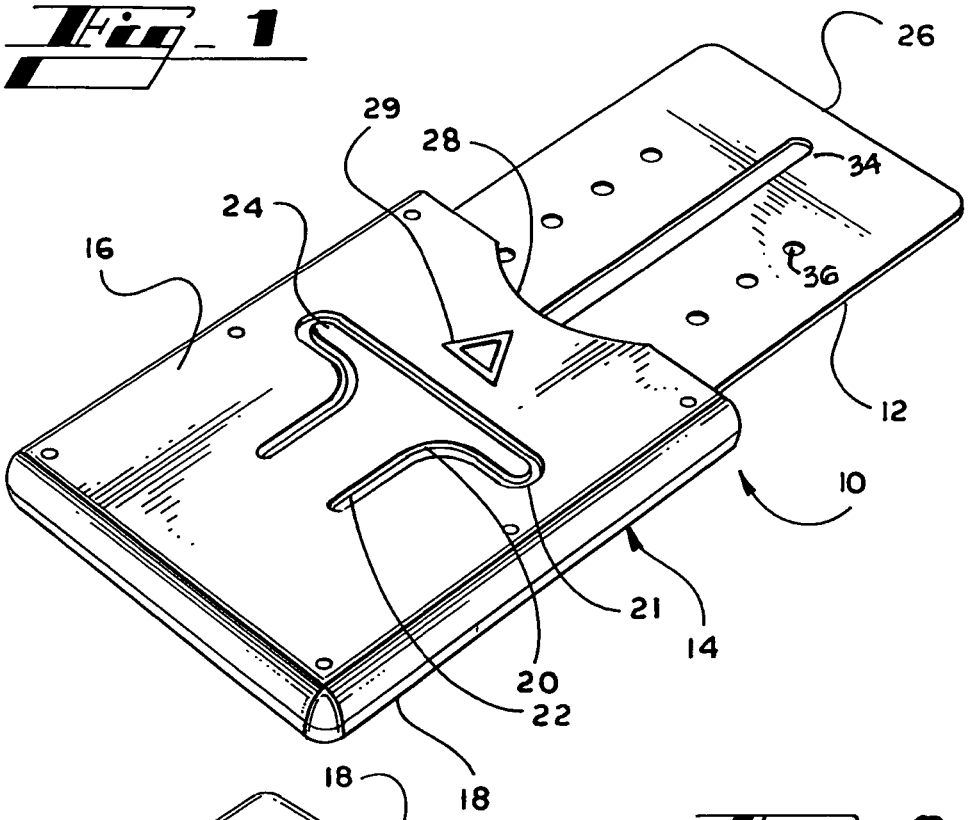
FIG. 1 is a bottom perspective view of a locking container, according to the present invention.

Referring now to the drawings, wherein like elements are represented by like numerals, there is shown in FIG. 1 a bottom perspective view of a locking container 10. The locking container 10 includes a tray 12 and a locking sleeve 14, comprising a base 16 and a top 18 that are attached together to form a void and at least one open end. The locking container 10 further includes means for unlocking the tray 12 from the locking sleeve 14. One non-limiting example of means for unlocking includes a manipulable biaser 20 comprising a T-shaped release bar 24 that is formed in an opening 21 of the base 16 and is connected to and integrally formed with the locking container 10 by a thin resilient section or lever 22. Other means for unlocking include release bars of various shapes and individual release buttons. A user releaseably slides tray 12 from locking sleeve 14 by exerting pressure and pushing on the free end of the T-shaped release bar 24 to free tray 12. The locking container 10 further includes a recess 28 formed in the open end of base 16 to enable a user to grip an exposed end 26 of tray 12. The locking container 10 may include indicia or an indicator, such as an arrow 29 for directing a user with regard to which direction to slide the tray 12.

Figure 2:
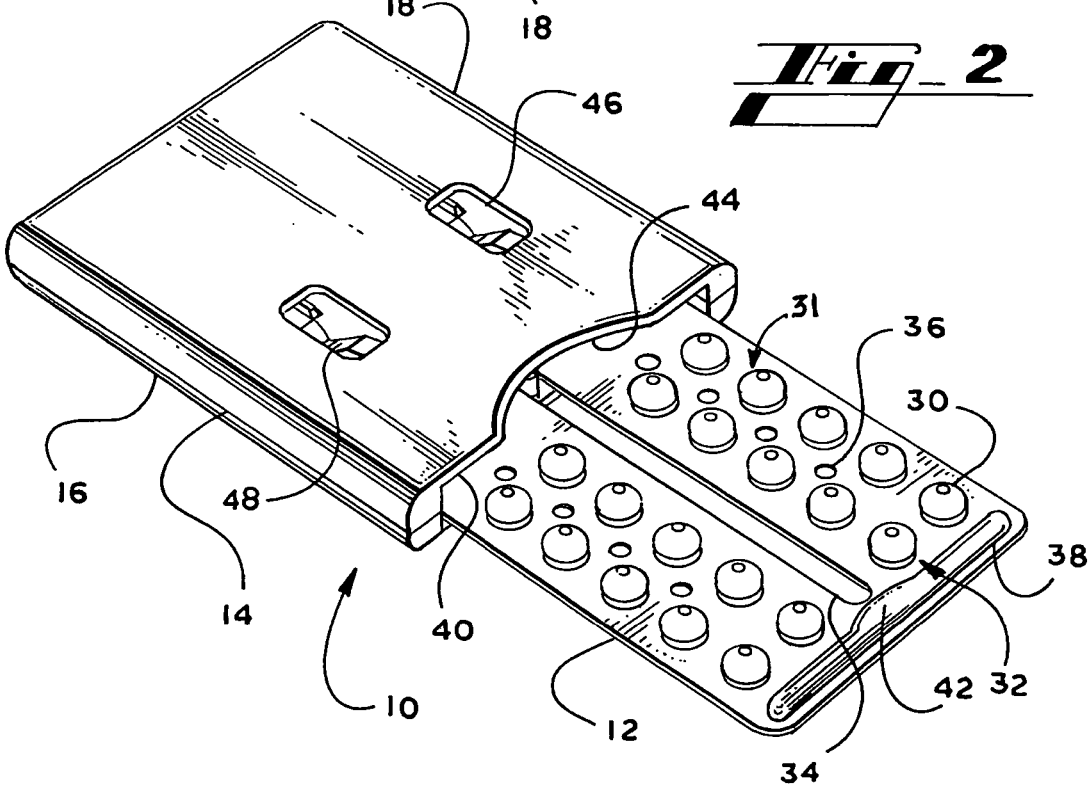

FIG. 2 shows a top perspective view of the locking container 10 and tray 12. As shown in FIG. 2, tray 12 includes item-containing compartments or blisters 30 for correspondingly holding at least one item 31, typically in each blister 30. The illustrated item-containing blisters 30 are arranged in four columns 32. It will be noted that the item-containing blisters 30 may be arranged in different orientations on the tray 12 without departing from the scope of the claims. Tray 12 may be fabricated or constructed from the same materials, strengths and thicknesses as conventional blister package trays. The blisters 30 may be formed in a single layer plastic top. The tray 12 includes a backing sheet comprising a sealed paper or foil base operable to seal at least one item 31 within at least one corresponding blister 30 and is dimensioned to fit within the locking sleeve 14.

With reference now to both FIGS. 1 and 2, the tray 12 further includes a control slot 34, which slideably guides the tray 12 within the locking sleeve 14 and forms a stopping end that prevents the tray 12 from completely sliding out of the locking sleeve 14. The tray 12 includes a plurality of receiving apertures or holes 36 that for the purpose of teaching and not limitation, are positioned in parallel series on the tray 12 and disposed between blisters 30. The holes 36 cooperate with means for locking 56 the tray 12 within the locking sleeve 14, as best illustrated in FIG. 4. One non-limiting example of means for locking 56 includes detents 56, which are formed on the base 16 of the locking container 10. Each detent 56 cooperates with a corresponding hole 36 to lock tray 12 in place and prevent the extraction of tray 12. The detents 56 sequentially align with the parallel series of holes 36 in order to limit access to a particular number of items 31 at one time. Means for locking further include catches, posts, springs, and the like, all of which may be positioned at various locations or in various configurations.

The tray 12 includes a rib 38 positioned at one end of the tray 12. As best illustrated in FIG. 3, when tray 12 is completely inserted within the locking sleeve 14, rib 38 presses up against the inside surface of top 18 and the rib 38 closes the open end 40 of the locking sleeve 14, preventing access to the item-containing blisters 30. Rib 38 includes a tab 42 which fits within cutout 44 when the tray 12 is fully inserted within locking sleeve 14. The tab 42 aids in sliding the tray 14 outward from the locking sleeve 14.

The top 18 of the locking container 10 includes openings 46 and means for urging 48. One non-limiting example of means for urging 48 includes resilient springs 48. The springs 48 press or urge tray 12 against base 16 to engage the detents 56 with correspondingly holes 36. It will be understood that means for urging 48 may comprise other suitable mechanisms that urge or press tray 12 against the base 16 such as springs of all kinds, ribs, posts, lugs, and the like, and combinations thereof.

Referring now to FIG. 4, there is shown an exploded view of a locking container 10 including a tray 12 disposed on a base 16. The top 18 includes connecting pins 51 and a central pin 55. The connecting pins 51 and the central pin 55 extend downward from the inside surface of top 18. The base 16 includes cylinders 50, which are positioned along side walls 52 of the base 16. Each individual cylinder 50 includes an aperture and energy director 60 for correspondingly receiving and securing pins 51. The base 16 further includes a stop or means for stopping 54. Non-limiting examples of a stop or means for stopping 54 include a lug or post 54. Other examples include springs, catches, detents, and the like, all of which act to stop or frustrate complete withdraw of a tray 12 from the container 10. The lug 54 is centered near recess 28 at the open end 40 of the base 16 to engageably receive central pin 55. The lug 54 extends through the control slot 34 of tray 12 and cooperates with the stopping end 84 of the control slot 34 to prevent the tray 12 from being easily extracted from the locking sleeve 14. As shown, detents 56 project through holes 36 of tray 12 to lock tray 12 within the locking sleeve 14. The tray 12 includes rib 58, located at one end of the tray 12, and raised dots 59 which extend upward from tray 12. The rib 58 and raised dots 59 ride against the inside surface of the top 18 to stabilize the tray 12 as the tray 12 is extended from the locking sleeve 14.

In one method of assembly, the tray 12 is placed on base 16 so that lug 54 extends through the control slot 34. The top 18 is subsequently pressed onto the base 16. The pins 51 and the central pin 55 are correspondingly inserted within the apertures of the cylinders 50 and stop 54. Energy directors 60 inside the cylinders 50 and side energy directors 62, which are disposed along side walls 52 of the base 16, help fuse and weld the top 18 to the base 16 under pressure and ultrasonic energy.

Figure 5:
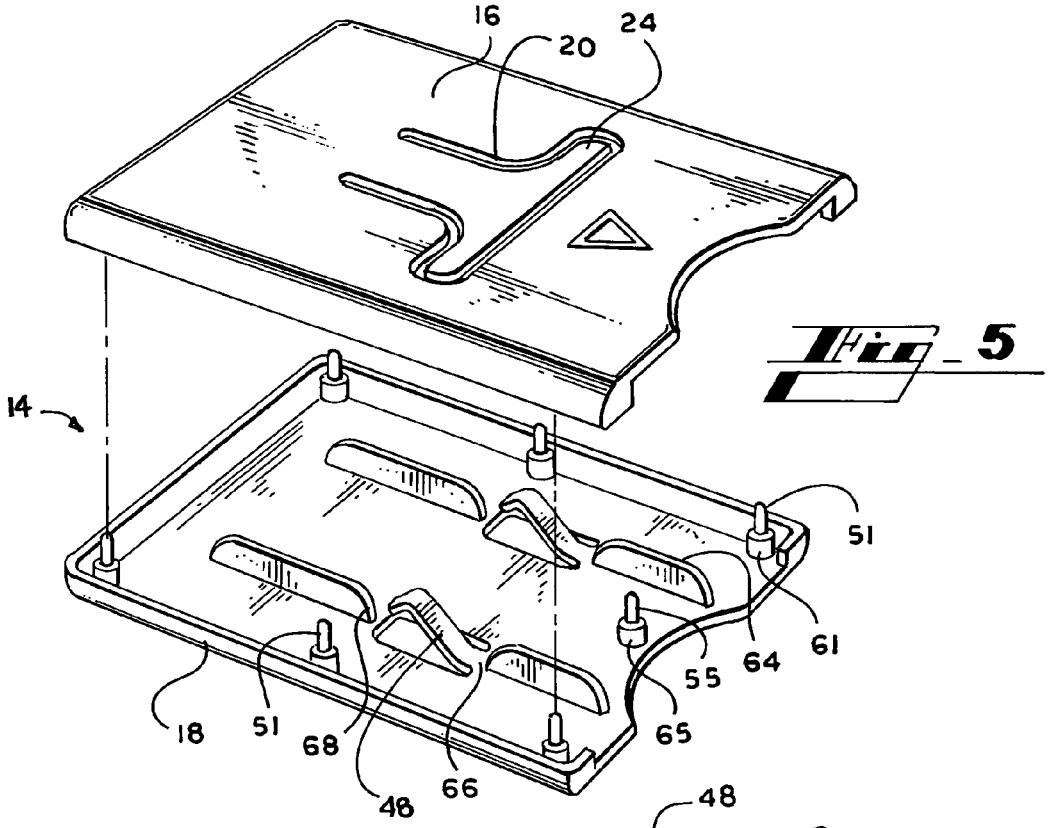
FIGS. 5 and 6 are exploded views of a locking sleeve, according to the present invention.
Figure 6:
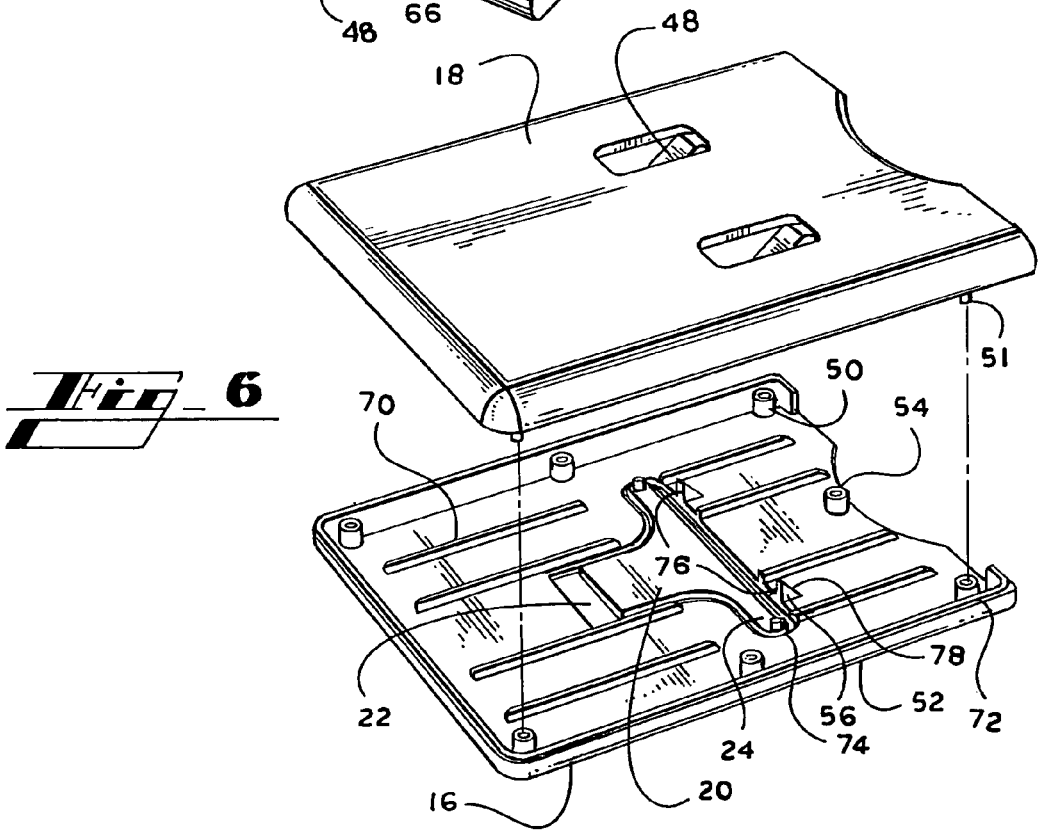

FIG. 5 is an exploded view of the locking sleeve 14 showing the inner surface of top 18 and base 16. As illustrated, top 18 of the locking sleeve 14 includes connecting pins 51 and central pin 55, which extend from cylindrical bases 61 and 65. The top 18 further includes ribs 64 that include inner ends 68. The ribs 64 are spaced apart to form gaps 66. The springs 48 extend inward into the locking sleeve 14 through the gaps 66. The springs 48 urge tray 12 against guides 70, which are disposed on the inside surface of base 16 as best illustrated in FIG. 6. The ribs 64 and springs 48 are of sufficient height so that the item-containing blisters 30 are spaced from the inside of the top 18. The head 24 of the biaser 20 is aligned with the springs 48, to allow a user to manipulate the tray 12 in the direction of the springs 48 and release the tray 12 from detents 56.

FIG. 6 is an exploded view of the locking sleeve 14 showing the inner surface of base 16 and the top 18. As illustrated, base 16 includes guides 70 for guiding and facilitating the sliding of tray 12. Base 16 further includes ridges 72 located at the inside of side walls 52. The ridges 72 fit inside of complementary side walls of top 18. Biaser 20 includes a rib 74 disposed on the inside of head 24 that cooperates with detents 56. When the biaser 20 is pushed inward, the rib 74 is also pushed inward so as to warp an adjacent part of tray 12 toward the top 18 against the force of springs 48, thereby disengaging the detents 56 from the holes 36 and releasing tray 12 to slide freely. As best shown in FIG. 4, the detents 56 correspondingly engage with holes 36 in order to hold and prevent the tray 12 from sliding. Detents 56 may include straight or hook-shaped, holding or locking inward faces 76. The detents 56 may also include sloping outer faces or ramp surfaces 78 that are configured to warp the tray 12 away from the detents 56, allowing free inward movement of tray 12. It will be noted that the detents 56 may include other suitable configurations of geometric shapes without departing from the scope of the present claims.

Referring now to FIGS. 7 and 8, there is shown a longitudinal cross-section view of the locking container 10. Detents 56 are shown with the locking or holding faces 76 engaging holes 36. In operation, the tray 12 is disengaged or unlocked by pushing biaser 20 inward. The inward movement of the biaser head 24 causes rib 74 to warp tray 12 toward top 18, in the area between inward facing ends 68 of ribs 64. The warping of the tray 12 disengages the detents 56 from holes 36, allowing tray 12 to be pulled outward from the locking sleeve 14. The tray 12 may be slid outward until the detents 56 reengage with the next series of holes 36, thereby limiting the amount of items 31 a user will have access to per sequence of unlocking and accessing.

As shown in FIG. 8, the detents 56 may include hooks 80 to ensure against unwanted outward movement of the tray 12. To gain access to additional items, the biaser 20 is again pushed and held inward to warp the tray 12 and disengage the detents 56 from holes 36, thereby allowing tray 12 to be slid out further from sleeve 14 to allow access to another limited amount of items 31. The detents 56 are selectively engaged within the parallel series of holes 36 to limit the dosage to a certain amount of items 31. In one embodiment of the present invention, a push, hold, pull and release sequence limits the exposure of blisters or blisters 36 to four. It will be understood that the holes 36 may be configured on the tray 12 to expose different quantities of blisters 36 at one time. After an item 31 is removed from an item-containing blister 30, reverse pressure is applied to tray 12 to reinsert it within the locking sleeve 14. The detents 56 include sloping ramp surfaces facing the open end of said sleeve 14 for biasing said tray 12 away from the detents 56 and disengaging the detents 56 upon sliding the tray 12 inward towards the closed end of the locking sleeve 14.

FIGS. 9 and 10 are perspective views of the base 16 and the tray 12. In FIG. 9, the tray 12 is fully extended outward from base 16, generally denoted as 82. The base 16 includes means for stopping 54, which engages with a stopping end 84 for preventing the tray 12 from being completely removed from the locking sleeve 14. As described, means for stopping includes stop 54 that extends through the control slot 34 of tray 12. The end 84 of control slot 34 engages with or abuts against the lug 54 to prevent the tray 12 from being extended out further.

It will be understood that in one alternative embodiment of the present invention, the locking container 10 of the present invention may be either disposable or reusable. In addition, tray 12 may be disposable so that a new tray 12 may be replaced within the locking container 10. Thus, the same locking container 10 may be refilled with a new tray 12. To that end, stop or lug 54 only partially extends between the base 16 and top 18 to form a gap (not shown). Manipulating the tray 12 through the gap permits complete withdraw of the tray 12 from the container 10.

As seen in FIG. 10, the tray 12 is shown in an innermost position 86. The lug 54 extends through control slot 34 of tray 12 and engages with or abuts against the end 88 of the control slot 34. The end 92 of tray 12 abuts the inside of the end wall 94 of base 16. The detents 56 extend through holes 36 of tray 12 to secure tray 12 within the locking container 10. The rib 38 closes the open end 40 of the locking sleeve 14, preventing access to the item-containing blisters 30. Rib 38 includes a tab 42 which fits within cutout 44 when the tray 14 is fully inserted within locking sleeve 14. The tab 42 aids in sliding the tray 14 outward from the locking sleeve 14.

FIG. 11 is a perspective view of the locking container 10. As shown, the biaser 20 includes a lever integrally formed with the base 16. The lever includes a hinge end that is hinged to said base 16 and a free end 24 that freely moves into the sleeve 14 for warping tray 12. The free end 24 of the lever is relatively wider and the hinged end is relatively narrower. The tray 12 is removed from the locking sleeve 14 by manipulating the biaser 20 inward and pulling tray 12, at recess 28, in the direction of arrow 29. It will be understood that the locking sleeve 14 may include a label, information, text, directions or other printed material.

Referring now to FIG. 12, there is shown a cross-sectional view of the locking sleeve 14 including a base 16 and a top 18 where the base 16 and the top 18 are attached or molded together to form the locking sleeve 14. The biaser 20 is molded to project inward into the locking sleeve 14 and the outer surface of the biaser 20 includes frictional grooves 96 to aid in pushing the biaser 20 inward. The springs 48 are molded to extend inward into the locking sleeve 14 from the surface of top 18 and the springs 48 extend slightly beyond the inward extension of ribs 64.

Figure 13:
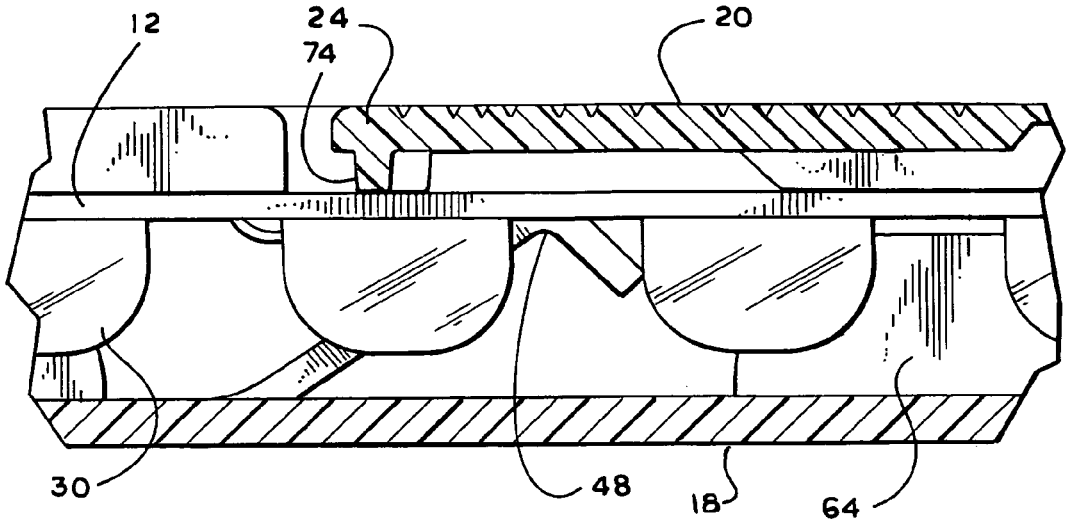
FIGS. 13 and 14 are cross-sectional views of the locking container showing the relationship of the base, top and tray, according to the present invention.
Figure 14:
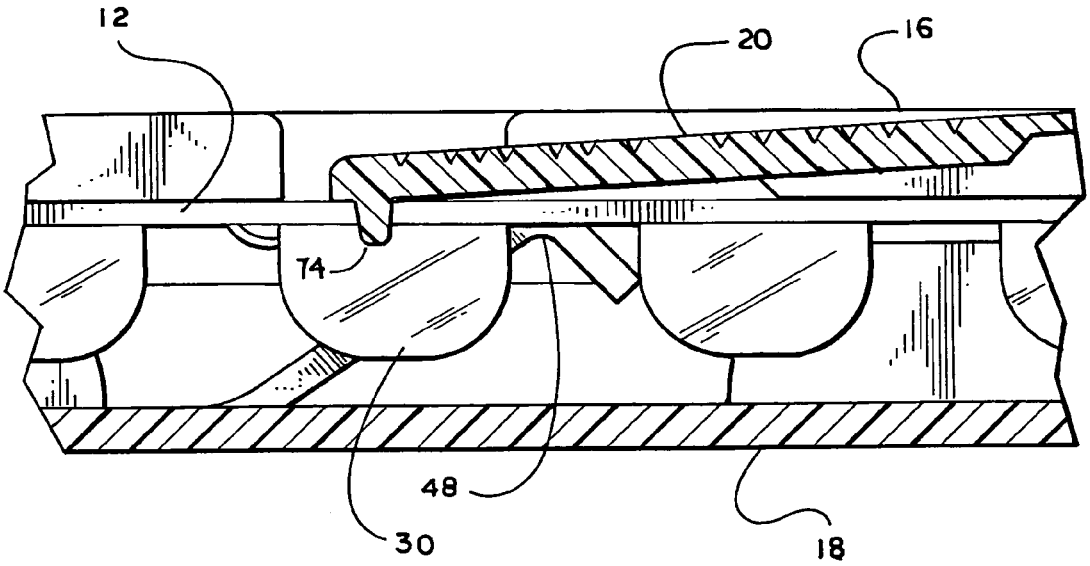

FIGS. 13 and 14 are cross-sectional views of the locking container 10. Tray 12 has been inserted within the locking sleeve 14. The springs 48 urge or press against tray 12, which pushes the biaser 20 outward to a position level with base 16. The sloping back surfaces 78 of the detents 56 and the inward surfaces of ribs 64 are used along with other tray-contacting surfaces to facilitate sliding of the tray 12. The free end 24 of the lever has an inward extension 74 for contacting with and warping tray 12.

Alternative embodiments of the present invention include methods of packaging items or products within a locking container 10. One method includes the steps of constructing a tray 12 to include a slot 34 extending through the tray 12, and a plurality of item-containing compartments or blisters 30. This method further includes the steps of loading and sealing at least one item 31 into at least one compartment 30 of tray 12. The tray 12 may be formed as a conventional blister package including a plurality of item-containing blisters 30. A conventional backing sheet or layer of plastic, or foil, or paper, seals each compartment 30, except those intentionally left open or unfilled.

The tray 12 is placed on the sliding guides 70 of base 16 and the stop 54 extends through the control slot 34 of tray 12. Means for locking 56 engage with or protrude through receiving apertures 36 of tray 12. The top 18 and base 16 are then connected together to form a locking sleeve 14 including a void and an open end. This method further includes the step of positioning means for locking 56 within said sleeve 14 to cooperate with the tray 12 in order to prevent the tray 12 from sliding within the locking sleeve 14. This method further includes the step of connecting a biaser 20 to the locking sleeve 14 for biasing means for locking 56 out of engagement with the tray 12 for sequentially limiting the sliding of the tray 12 through the locking sleeve 14.

In a further embodiment of the present invention, there is shown a method of dispensing at least one item 31 from a locking container 10. This method of dispensing at least one item 31 includes pressing the biaser 20 inward to warp a part of tray 12 between ribs 64 against the force of springs 48 away from base 16 so that detents 56 disengage away from corresponding holes 36. This method of dispensing further includes sliding tray 12 out from the open end 40 of the locking sleeve 14. Pressure is then applied to an item-containing blister 30 to punch or rupture the backing sheet and remove an item 31 from the item-containing blister 30. The tray 12 is then slid back into the locking sleeve 14 to allow the detents 56 to engage with the holes 36 to securely hold the tray 12 within the locking container 10.

The law does not require and it is economically prohibitive to illustrate and teach every possible embodiment of the present claims. Hence, the above-described embodiments are merely exemplary illustrations of implementations set forth for a clear understanding of the principles of the invention. Many variations of combinations may be made to the above-described embodiments without departing from the scope of the claims. All such variations of combinations are included herein by the scope of this disclosure and the following claims.

I claim:

1. A system for dispensing items, comprising:

a substantially planar tray comprising:

a control slot;

at least one compartment configured to hold at least one item; and at least one locking aperture therethrough;

a sleeve comprising:

a plurality of walls defining a void;

an opening proximate the void, the opening configured to translateably receive the tray;

a stop extending into the void and through the control slot, the stop configured to slide along the length of the slot between opposite ends thereof;

a locking mechanism extending into the void, the locking mechanism configured to releaseably engage the at least one locking aperture; and an unlocking mechanism that can be biased into the void to release, the locking mechanism from engagement with the at least one locking aperture.

2. The system of claim 1, wherein one of the tray and the sleeve further comprises a biasing mechanism configured to urge the tray toward the locking mechanism.

3. The system of claim 1, further comprising a plurality of spaced apart locking apertures configured to selectively engage the locking mechanism.

4. A method of packaging items within a container, comprising the steps of:

providing a tray configured to hold at least one item, the tray including a plurality of spaced apart receiving apertures;

providing a sleeve that includes a void and an opening configured to slidably receive the tray;

providing the sleeve with at least one locking mechanism extending into the void and configured to selectively engage at least one of the receiving apertures;

locating within the void a biasing mechanism configured to urge the tray toward the at least one locking mechanism; and providing the sleeve with an unlocking mechanism that can be biased into the void toward the biasing mechanism.

5. The method of claim 4, further comprising the step of inserting the tray into the void until the locking mechanism releasably engages at least one of the plurality of receiving apertures.

6. The method of claim 4, further comprising:

providing the tray to comprise a slot extending along a length of the tray; and providing the sleeve with a stop that is slidable within the slot.

7. The method of claim 4, further comprising the step of biasing the unlocking mechanism toward the biasing mechanism to disengage the one of the plurality of receiving apertures from the locking mechanism.

8. A system for dispensing items, comprising:

a substantially planar tray including:

a plurality of compartments distributed along a length of the tray, at least one of the compartments configured to hold at least one item; and a plurality of receiving apertures aligned along a length of the tray;

a sleeve including:

a locking mechanism positioned to releasably engage at least one of the plurality of receiving apertures to selectively restrict movement of the tray; and an unlocking mechanism that can be biased into the sleeve to disengage at least one of the plurality of receiving apertures from the locking mechanism.

9. The system of claim 8, wherein the tray further includes a slot with opposing ends and the sleeve further includes a stop that is slidable along the length of the slot.

10. The system of claim 8, wherein the sleeve further includes a base and a top attached to one another.

11. The system of claim 8, wherein one of the tray and the sleeve further includes a biasing mechanism that extends into the sleeve toward the locking mechanism.

12. A system for storing and dispensing items, comprising:

a substantially planar tray with at least one locking aperture therethrough; and a sleeve comprising:

a plurality of sides that form a void configured to receive the tray;

an opening proximate the void through which the tray is at least partially passed;

at least one engagement mechanism, located substantially within the void, configured to engage the at least one locking aperture;

at least one biasing mechanism configured to urge the locking aperture to engage the at least one engaging mechanism; and a release proximate the engagement mechanism configured to selectively disengage the engagement mechanism from the aperture.

13. The system of claim 12, wherein the tray further comprises a stop aperture, and the sleeve further comprises a stop, wherein:

the stop engages at least a portion of the stop aperture to prevent complete removal of the tray.

14. The system of claim 13, wherein the biasing mechanism comprises at least one spring.

15. The system of claim 13, wherein the tray comprises at least one compartment for holding at least one item.

16. The system of claim 15, wherein the tray comprises a blister pack.

17. The system of claim 16, wherein the biasing mechanism comprises at least one rib.

18. The system of claim 17, wherein the release comprises a release button.

19. The system of claim 18, wherein the tray comprises a plurality of locking apertures.

20. The system of claim 12, wherein the tray comprises at least one compartment for holding at least one item.

21. The system of claim 20, wherein the tray comprises a blister pack.

22. The system of claim 12, wherein the biasing mechanism comprises at least one rib.

23. The system of claim 12, wherein the biasing mechanism comprises at least one spring.

24. The system of claim 12, wherein the release comprises a release button.

25. The system of claim 12, wherein the tray comprises a plurality of locking apertures.

26. A sleeve comprising:

a plurality of sides that form a void configured to receive a substantially planar tray with at least one locking aperture therethrough;

an opening proximate the void through which the tray to be receive can be at least partially passed;

at least one engagement mechanism, located substantially within the void, the engagement mechanism configured to engage the at least one locking aperture of the tray to be received; and a release proximate the engagement mechanism, the release configured to selectively disengaged the engagement mechanism from the aperture, wherein the sleeve further comprises at least one biasing mechanism configured to urge the locking aperture of the tray to be received in the sleeve to engage the at least one engaging mechanism.

27. The sleeve of claim 26, wherein the sleeve further comprises a stop, the stop configured to engage at least a portion of a stop aperture formed in the tray to be received in the sleeve, to prevent complete removal of the tray from the sleeve.

28. The sleeve of claim 27, wherein the biasing mechanism comprises at least one spring.

29. The sleeve of claim 27, wherein the tray to be received in the sleeve comprises at least one compartment for holding at least one item.

30. The sleeve of claim 29, wherein the tray to be received in the sleeve comprises a blister pack.

31. The sleeve of claim 30, wherein the biasing mechanism comprises at least one rib.

32. The sleeve of claim 31, wherein the release comprises a release button.

33. The sleeve of claim 32, wherein the tray to be received in the sleeve comprises a plurality of locking apertures.

34. The sleeve of claim 26, wherein the tray to be received in the sleeve comprises at least one compartment for holding at least one item.

35. The sleeve of claim 34, wherein the tray to be received in the sleeve comprises a blister pack.

36. The sleeve of claim 26, wherein the biasing mechanism comprises at least one rib.

37. The sleeve of claim 26, wherein the biasing mechanism comprises at least one spring.

38. The sleeve of claim 26, wherein the release comprises a release button.

39. The sleeve of claim 26, wherein the tray to be received in the sleeve comprises a plurality of locking apertures.

40. A system for storing and dispensing items, comprising:

a substantially planar blister tray comprising a plastic top layer having a plurality of blisters formed therein and a blister-sealing base layer, the tray further having at least one locking aperture extending therethrough; and a sleeve comprising:

a plurality of sides that form a void configured to receive the tray;

an opening proximate the void through which the tray is at least partially passed;

at least one engagement mechanism, located substantially within the void, configured to engage the at least one locking aperture;

at least one biasing mechanism configured to urge the locking aperture to engage the at least one engaging mechanism; and a release proximate the engagement mechanism configured to selectively disengage the engagement mechanism from the aperture.

41. The system of claim 40, wherein the tray further comprises a stop aperture, and the sleeve further comprises a stop, wherein:

the stop engages at least a portion of the stop aperture to prevent complete removal of the tray.

42. The system of claim 41, wherein the biasing mechanism comprises at least one spring.

43. The system of claim 41, wherein the tray comprises at least one compartment for holding at least one item.

44. The system of claim 43, wherein the tray comprises a blister pack.

45. The system of claim 44, wherein the biasing mechanism comprises at least one rib.

46. The system of claim 45, wherein the release comprises a release button.

47. The system of claim 46, wherein the tray comprises a plurality of locking apertures.

48. The system of claim 40, wherein the tray comprises at least one compartment for holding at least one item.

49. The system of claim 48, wherein the tray comprises a blister pack.

50. The system of claim 40, wherein the biasing mechanism comprises at least one rib.

51. The system of claim 40, wherein the biasing mechanism comprises at least one spring.

52. The system of claim 40, wherein the release comprises a release button.

53. The system of claim 40, wherein the tray comprises a plurality of locking apertures.

* * * * *